United States Patent [19]

Hall et al.

[11] Patent Number: 4,921,401

[45] Date of Patent: May 1, 1990

[54] CASTING FOR A ROTARY MACHINE

[75] Inventors: Theodore W. Hall, Rocky Hill; Kenneth H. Klapproth, Manchester, both of Conn.

[73] Assignee: United Technologies Corporation, Hartford, Conn.

[21] Appl. No.: 314,535

[22] Filed: Feb. 23, 1989

[51] Int. Cl.[5] ..... F01D 25/24

[52] U.S. Cl. ..... 415/138; 415/116; 403/28; 403/344

[58] Field of Search ..... 415/1, 134, 135, 136, 415/137, 138, 139, 115, 116; 60/39.75, 39.83; 403/28, 29, 30, 408.1, 344

[56] References Cited

U.S. PATENT DOCUMENTS

| | | | |
|---|---|---|---|
| 2,472,062 | 6/1949 | Boestad et al. | 415/139 |
| 3,759,038 | 9/1973 | Scalzo et al. | 415/134 |
| 4,184,689 | 1/1980 | Brodell et al. | 415/134 |
| 4,247,248 | 1/1981 | Chaplin et al. | 415/136 |
| 4,302,941 | 12/1981 | DuBell | 60/757 |
| 4,411,134 | 10/1983 | Moir | 403/344 |
| 4,431,373 | 2/1984 | Monsarrat | 415/199.5 |
| 4,502,809 | 3/1985 | Geary | 403/28 |
| 4,627,233 | 12/1986 | Baran, Jr. | 415/115 |
| 4,635,332 | 1/1987 | Cederwall et al. | 415/139 |
| 4,764,084 | 8/1988 | Parker et al. | 403/28 |

FOREIGN PATENT DOCUMENTS

| | | | |
|---|---|---|---|
| 1202356 | 1/1960 | France | 415/136 |
| 842244 | 6/1981 | U.S.S.R. | 403/408 |
| 1168755 | 7/1985 | U.S.S.R. | 403/408.1 |

*Primary Examiner*—Robert E. Garrett
*Assistant Examiner*—John T. Kwon
*Attorney, Agent, or Firm*—Gene D. Fleischhauer

[57] ABSTRACT

A stator assembly 20 for a rotary machine 10 includes an outer case 22 and an inner case 56 which is positioned from the outer case. The inner case is formed of segments 76 which overlap and which are relatively slidable in the circumferential direction. Various construction details are developed to keep the segments in an overlapping relationship. In one embodiment, a fastener 104 and slot 102 configuration are used to limit relative circumferential movement between the segments.

17 Claims, 6 Drawing Sheets

CASTING FOR A ROTARY MACHINE

TECHNICAL FIELD

This invention relates to rotary machines and more particularly to a stator assembly having a casing, such as an inner case, which is adjacent to a working medium flowpath. This invention was developed in the field of aircraft gas turbine engines and has application to rotary machines in other fields that employ a casing formed of circumferential segments adjacent to the flowpath for a working medium fluid.

BACKGROUND OF THE INVENTION

One example of an axial flow rotary machine is a gas turbine engine of the type used to propel aircraft. An aircraft gas turbine engine typically has a compression section, a combustion section, and a turbine section. An annular flowpath for working medium gases extends axially through the engine. A stator assembly extends axially through the engine and about the working medium flowpath. A rotor assembly extends axially through the sections of the engine and inwardly of the stator assembly. The rotor assembly includes rows of rotor blades which extend outwardly from the rotor across the working medium flowpath in both the turbine and compression sections.

The stator assembly includes an engine case which bounds the working medium flowpath and which is disposed outwardly of the rotor assembly. Rows of stator vanes extend inwardly from the engine case and across the working medium flowpath into proximity with the rotor assembly. The rows of stator vanes are located upstream of the associated row of rotor blades to direct the working medium gases into the downstream row of rotor blades.

One example of a gas turbine engine having a stator assembly and a rotor assembly is shown in U.S. Pat. No. 4,627,233 issued to Baran entitled "Stator Assembly For Bounding The Working Medium Flowpath Of A Gas Turbine Engine". In this construction, the stator assembly includes an outer case and a wall bounding the working medium flowpath which is formed of a plurality of circumferentially extending wall segments, such as the duct 34 and the stator vanes 32. An inner casing in the form of a seal member 86 extends circumferentially between the outer case and the wall elements to form a cooling air chamber outwardly of the inner casing and to block hot gases from the working medium flowpath from the mixing with the cooling air chamber, or air from the cooling air chamber flowing into the working medium flowpath.

The seal member might be formed of relatively thin sheet metal material and formed in a single circumferentially continuous piece. However, the circumferential continuity may result in the seal element being cracked or warped during transient operative conditions of the engine as the outer case changes its diameter at a different rate from the inner case in response to transient thermal conditions of the engine.

A second example of an engine structure employing rotor blades and stator vanes inwardly of an outer case is shown in U.S. Pat. No. 4,431,373 issued to William G. Monsarrat which is entitled "Flow Directing Assembly For A Gas Turbine Engine." In Monsarrat, the compression section of the engine includes an inner case and an outer case or annular sleeve. The outer case is attached to the inner case and positions the segments circumferentially about the rotor assembly during operation of the engine.

The inner case extends axially in the engine outwardly of an annular flowpath for working medium gases. The inner case is formed of a plurality of arcuate segments which are circumferentially adjacent one to the other. Adjacent arcuate segments are spaced circumferentially leaving a circumferential clearance gap G therebetween.

The engine also includes a plurality of cooling tubes which extend circumferentially about the exterior of the outer case. The cooling tubes impinge cooling air under preselected operative conditions of the engine to adjust the radial clearance between the inner case and the rotor assembly. As the cooling air is impinged on the outer case, the outer case contracts and moves inwardly to a smaller diameter, forcing the inner case to a smaller diameter and decreasing the clearance gap G between adjacent arcuate segments and decreasing the radial gap between the rotor assembly and the stator assembly.

The circumferential gap G between adjacent arcuate segments allows the segments to slidably accommodate the inward and outward movmment of the outer case. The gap decreases resistance by the inner case to movement of the outer case; and, it avoids crushing or stretching of the inner case by the outer case at operative conditions where the outer case has a different diameter than the inner case, such as might occur during transient operating conditions of the engine because of differences in thermal expansion between the inner case and the outer case.

As shown in FIG. 4 of U.S. Pat. No. 4,431,373, the adjacent arcuate segments overlap each other to provide sealing. Alternatively, a means for sealing, such as a feather seal, extends circumferentially between the adjacent arcuate segments of the inner case.

The above constructions notwithstanding, scientists and engineers under the direction of Applicant's assignee are working to develop inner cases which have having an acceptable fatigue life while accommodating changes in diameter of the outer case and while blocking the movement of gases.

DISCLOSURE OF THE INVENTION

This invention is in part predicated on the recognition that expansion and contraction of the outer case may not occur uniformly and that the engagement between the outer case and the inner case may cause the adjacent structure to exert unequal frictional forces on adjacent arcuate segments causing some segments to move more than other segments in the circumferential and radial directions. This may cause overlapping segments to move radially or circumferentially out of a close overlapping relationship which blocks the flow of gases between a chamber on one side of the inner case and the working medium flowpath on the other side of the case.

According to the present invention, a stator assembly for a rotary machine includes a casing extending circumferentially with respect to the flow path and having at least two circumferentially extending segments which are spaced circumferentially leaving a gap therebetween which overlap in the circumferential direction and which slidably engage each other, one of the segments having a slot and the other having a fastener which extends radially through the slot to radially trap the slotted segment, the slot extending circumferentially to permit circumferential movement between the segments.

In accordance with another embodiment of the present invention, the fastener extends between a pair of axially and circumferentially extending plates which are radially spaced to receive the slotted segment in nested fashion such that the two plates overlap the adjacent segment to provide two circumferentially extending seals to the circumferential gap between adjacent segments.

. In accordance with one embodiment of the present invention, the slot has an end between the nested end of the segment and the fastener to limit relative circumferential movement between adjacent segments to a predetermined maximum value.

In accordance with one detailed embodiment of the present invention, the fastener disposed in the slot has a thickness which is slightly greater than the radial thickness of the segment having the slot to preset the radial gap between the nested segment and the two plates to minimize leakage while providing adequate clearance to reduce friction between the adjacent segments.

According to the present invention, a method of assembling a gas turbine engine includes the steps of forming a circumferentially continuous outer case which is adapted to extend about the working medium flowpath; forming a freestanding inner casing formed of a plurality of circumferentially extending segments, each of the segments overlapping the adjacent segment in the circumferential direction and being capable of slidably engaging the segments in the circumferential direction, the adjacent segments at each end having a circumferentially extending slot in one of the segments, the slot having two ends and the other segment having a fastener which extends radially into the slot and between the ends of the slot to limit relative circumferential movement between the segments; and, installing the freestanding inner casing as a unit which is linked together by the fastener and the slot construction to positively align the segments in the circumferential and axial direction; and, attaching the inner case to the outer case such that the inner case is spaced radially over at least a portion of the inner case from the outer case and is positioned by the outer case.

A primary feature of the present invention is a stator assembly for a gas turbine engine which includes an inner case formed of a plurality of arcuate segments which are spaced circumferentially. At least one segment overlaps the adjacent segment in the circumferential direction and has a fastener which extends radially from the end of the segment to slidably engage the adjacent segment. Another feature is a slot in the adjacent segment. The fastener is disposed in the slot to permit relative circumferential movement. In one embodiment, the slot is closed in the circumferential direction to limit the circumferential gap that results from relative circumferential movement to a predetermined maximum value. In one detailed embodiment the slot has two circumferential ends which are both engaged by the fastener to limit relative circumferential movement between the adjacent segments in both circumferential directions. In one embodiment of the present invention, the segment carrying the fastener has a pair of circumferentially and axially extending plates. The plates overlap the adjacent segment. The fastener is a rivet which extends through both plates. The fastener includes a spacer disposed in the slot between the two plates. The plates are urged radially against the spacer by the rivet which applies a compressive force to the assembly. In one detailed embodiment, each segment engages the adjacent segment with a fastener and slot connection to form a freestanding inner case.

A principal advantage of the present invention is the engine efficiency which results from blocking the movement of gases between engine chambers with an inner case of circumferentially overlapping segments which stay in overlapping engagement under all operative conditions of the engine. Another advantage is the ease of assembly which results from the freestanding inner case having adjacent segments which are restricted against slidable disengagement during handling while providing a positive axial and radial alignment to the segments of the inner case. In one detailed embodiment, an advantage is the engine efficiency and durability of the case which results from avoiding binding between segments with a preset radial clearance between segments while minimizing the radial gap between adjacent segments to decrease leakage between the adjacent segments. In still another detailed embodiment, an advantage is the engine efficiency which results from blocking the leaking gases with two seals connected by a chamber by using a pair of axially and circumferentially extending plates to carry the fastener.

The foregoing features and advantages of the present invention become more apparent in light of the following detailed description of the best mode carrying out the invention and in the accompanying drawing.

BEST MODE FOR CARRYING OUT THE INVENTION

Figure 1:
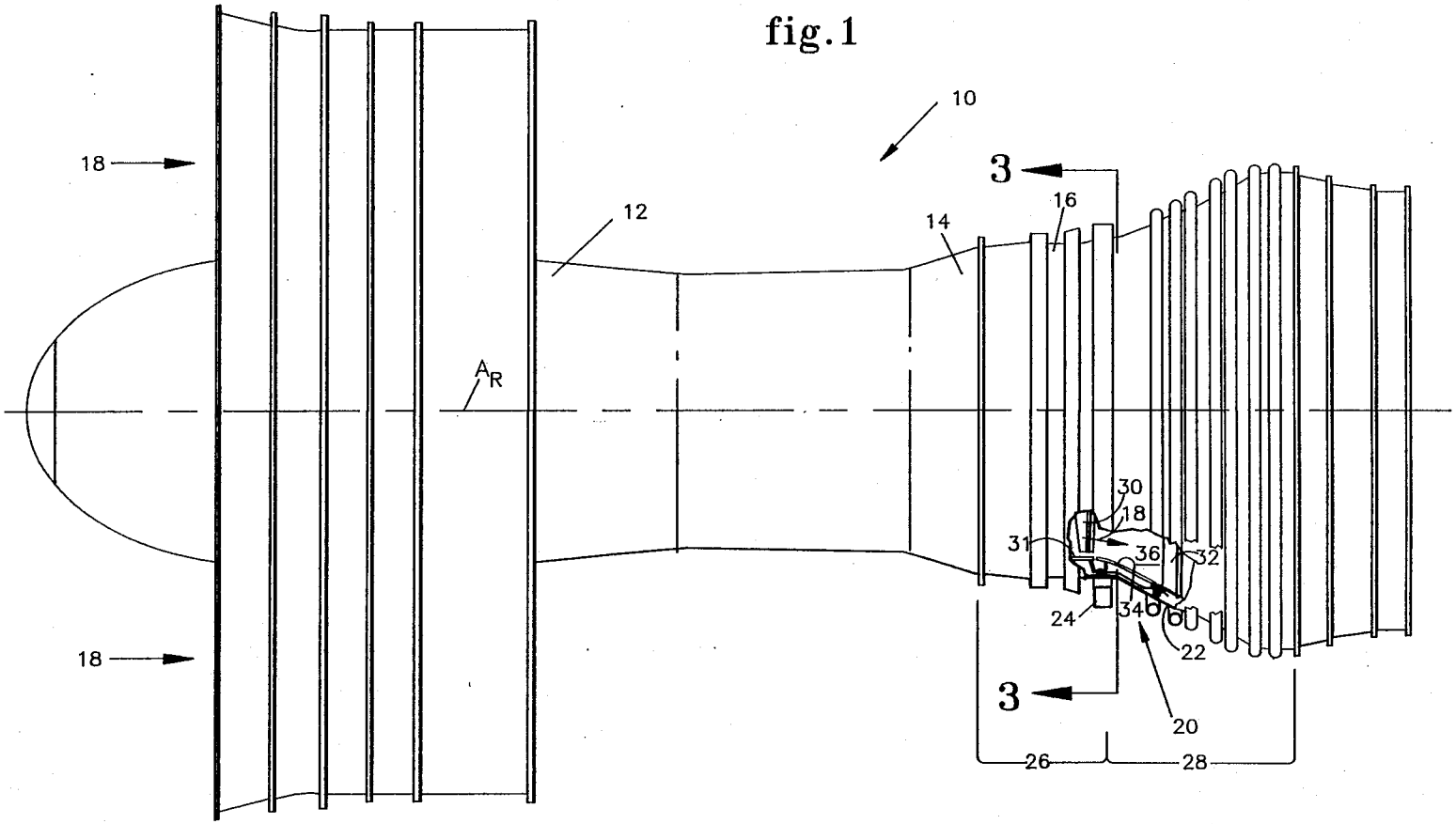
FIG. 1 is a side elevation view of an axial flow, gas turbine engine with a portion of the outer case broken away to show a portion of the turbine section.

FIG. 1 is a side elevation view of an axial flow rotary machine 10 which has a axis of rotation $A_r$. The engine has a compression section 12, a combustion section 14, and a turbine section 16. An annular flowpath 18 for working medium gases extends axially through the sections of the engine. A stator assembly 20 extends axially through these sections to bound the working medium flowpath. The stator assembly includes an outer case 22 which extends circumferentially about the working medium flowpath.

A plurality of cooling air tubes 24 in the turbine section 16 extend circumferentially about the outer case 22. The cooling air tubes are in flow communication with a source of cooling air, such as the compression section 12. The tubes are adapted to impinge cooling air on the outer case during preselected operating conditions of the engine to adjust internal operating clearances in the turbine section.

The turbine section 16 includes a high pressure turbine 26 and a low pressure turbine 28. An array of rotor blades in the high pressure turbine, represented by the single rotor blade 30, extend outwardly across the working medium flowpath. An outer air seal assembly 31 is attached to the outer case 22 and is spaced radially from the array of rotor blades leaving a radial clearance gap therebetween.

In the low pressure turbine 28, the stator assembly includes an array of stator vanes as represented by the single stator vane 32. A wall 34 bounds the working medium flowpath and is contoured to allow the gases of the flowpath to expand through the transition region 36.

Figure 2:
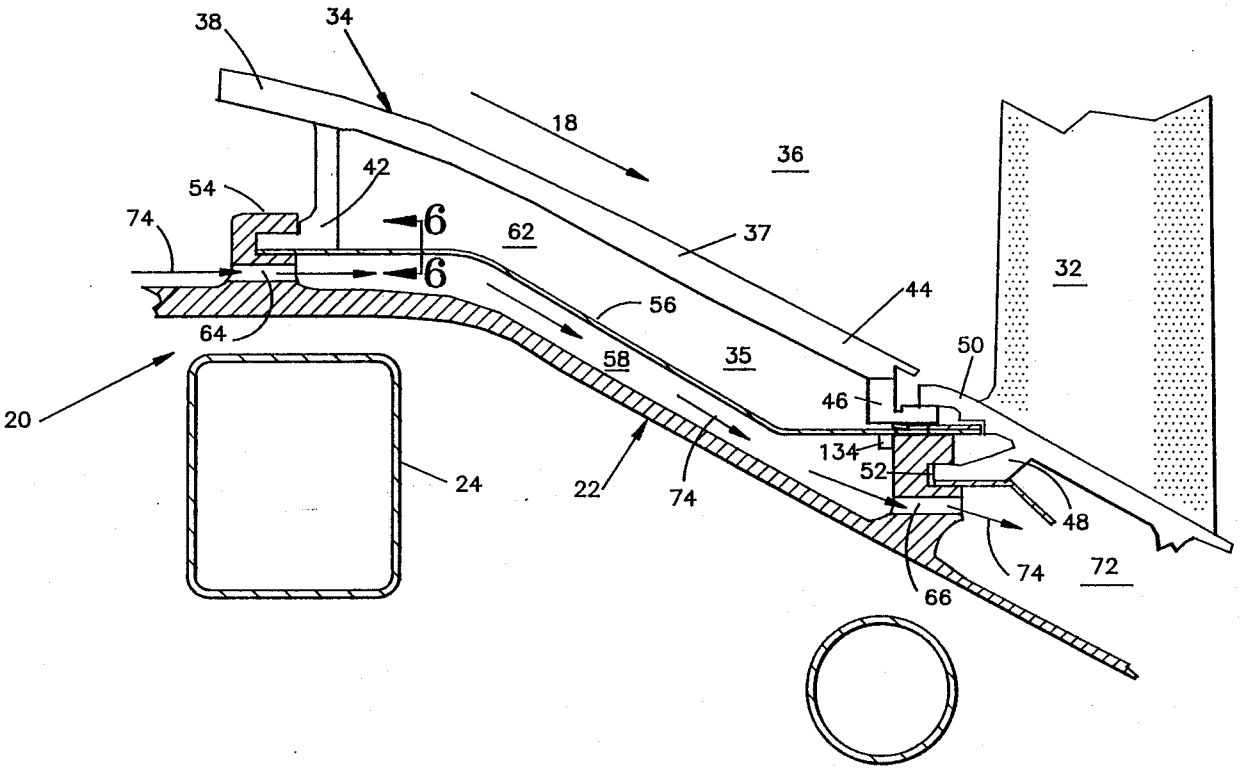
FIG. 2 is an enlarged cross-sectional view of a portion of the turbine section shown in FIG. 1.

FIG. 2 is an enlarged cross-sectional view of a portion of the gas turbine engine 10 shown in FIG. 1 showing in more detail elements of the stator assembly 20 such as the outer case 22, the array of stator vanes 32, and the wall element 34.

The wall 34 is spaced radially from the outer case leaving a circumferentially extending cavity 35 therebetween. The wall has a plurality of arcuate wall elements, as represented by the single arcuate wall element 37. Each wall element has an upstream end 38 having a flange 42 and a downstream end 44 having a flange 46.

The flanges 42,46 of the wall segment are radially attached to the outer case such that the outer case radially positions the wall elements. For example, the downstream flange 46 of the wall segment is attached to the outer case by a pair of radially spaced flanges 48,50 on each vane which engage a flange 52 the outer case and overlap the downstream flange 46. The upstream flange 42 of the wall segment engages a flange 54 on the outer case which attaches the upstream end of the segment to the outer case. Each of the flanges 44,46 capable of circumferential movement with respect to the outer case.

An inner casing, such as the inner case or baffle 56, is disposed between the wall and the outer case. The inner case extends circumferentially about the engine to divide the cavity 35 into a cooling air chamber 58 and a buffer gas region 62. As shown in FIG. 2, the inner case is trapped between the wall 34 and the outer case.

A plurality of holes through the upstream flange 54, as represented by the hole 64, place the cooling air chamber 58 in flow communication with an upstream source of cooling air. A plurality of holes through the downstream flange 52, as represented by the hole 66, place the cooling air chamber 58 in flow communication with a downstream cooling air region 72 of the engine. A flowpath 74 for cooling air extends axially through the engine between the outer case and the wall 34 through holes 64, chamber 58 and holes 66. The flowpath is bounded by the inner case 56 or baffle which extends axially from the upstream flange to the downstream flange.

Figure 3:
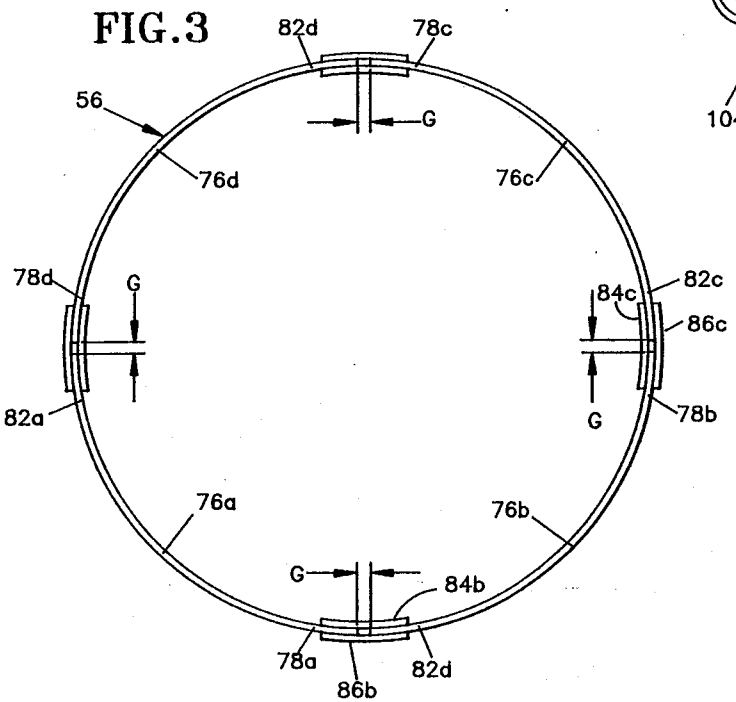
FIG. 3 is a cross-sectional view of the inner case of the turbine section shown in FIG. 2 taken along the lines 3—3 of FIG. 1.

FIG. 3 is a cross-sectional view taken along the line 3—3 of FIG. 1 with adjacent portions of the stator assembly, such as the outer case 22 and the wall 34, broken away for clarity to show only the inner case 56. The inner case is formed of a plurality of arcuate segments, that is, two or more arcuate segments. In the embodiment shown, there are four arcuate segments **76*a*,76*b*,76*c* an 76*d*. Each segment has a first end 78 and a second end 82. The first end of the first segment is spaced circumferentially from the second end of the second segment leaving the circumferential gap G therebetween. The second segment has pair of plates 84,86** which are spaced radially leaving a radial gap therebetween. The first segment extends circumferentially and axially into the radial gap between the plates such that the plates overlap the second segment.

Figure 4:
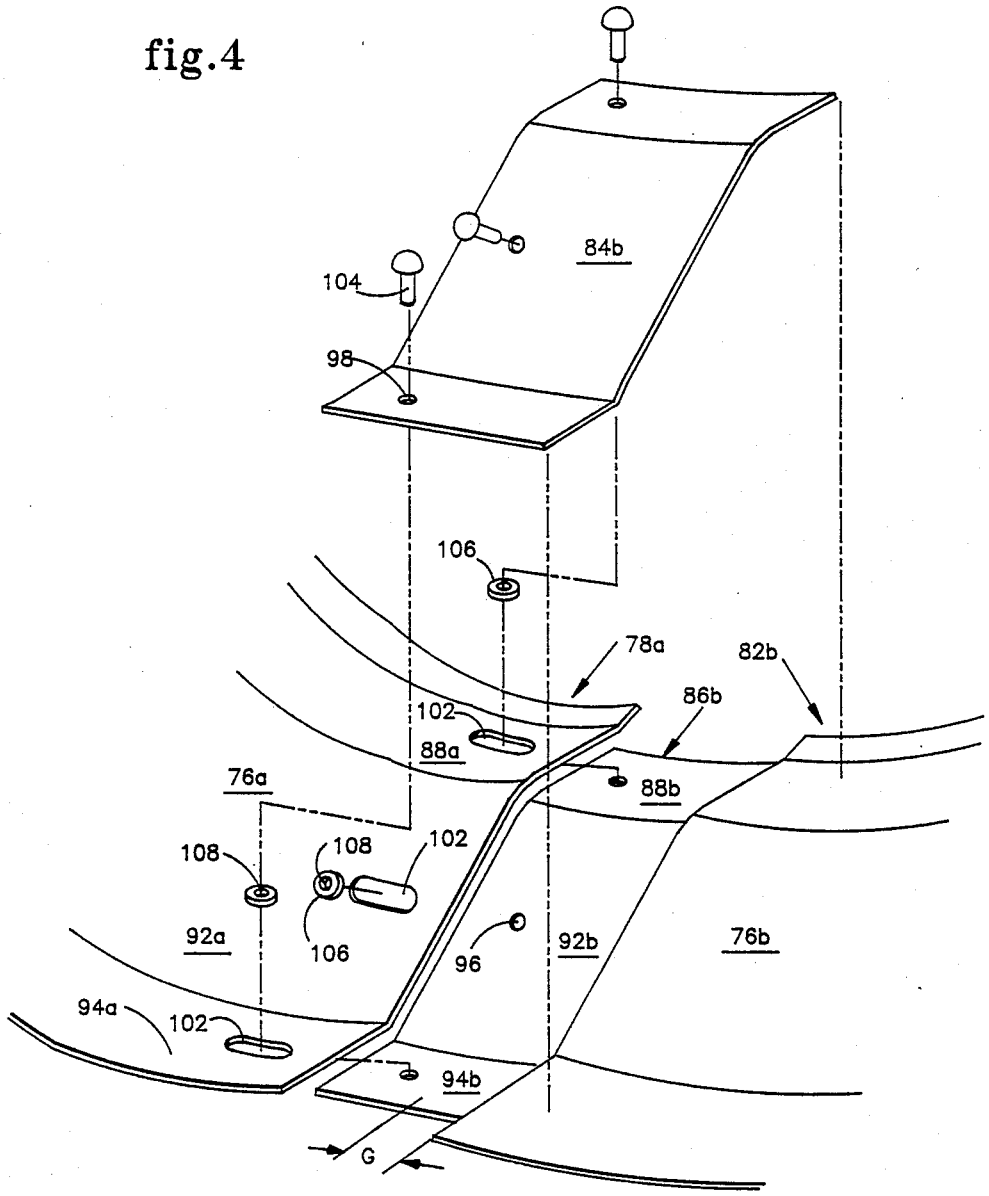
FIG. 4 is a partial perspective view of a portion of the inner case shown in FIG. 3 which is exploded to show the relationship of an inner plate, an outer plate and spacers disposed in the slot of a nested arcuate segment of the inner case, and rivets which urge the two plates radially against the adjacent spacer.

FIG. 4 is partial perspective, exploded view showing the relationship of the first segment **76*a* to the second segment 76*b*. The pair of plates includes the inner plate 84*b* and the outer plate 86*b*. Each plate may be attached by any suitable fastener, by bonding, by welding or the like to the remainder of the segment. Each plate has a first section 88, a second section 92 and a third section 94. At the second end of the second segment as shown by the second end 82*b*, each section has a hole 96 extending through the outer plate 86*b* which is aligned with an associated hole 98 in the inner plate 84*b***.

The first segment **76*a* extends within the radial gap between the plates 84*b*, 86*b*, and is referred to as the nested segment. The nested segment has a second end 82*a* (not shown) which is identical to the second end 82*b*. The nested segment has a first end 78*a* which has three circumferentially extending slots 102. Each slot is aligned with an associated hole in the inner plate and the outer plate. A fastener, as represented by a rivet 104 at each pair of holes 98,96 extends through the holes in the plates. A spacer 106 disposed in the slot has a hole 108** which receives the rivet.

Figure 5:
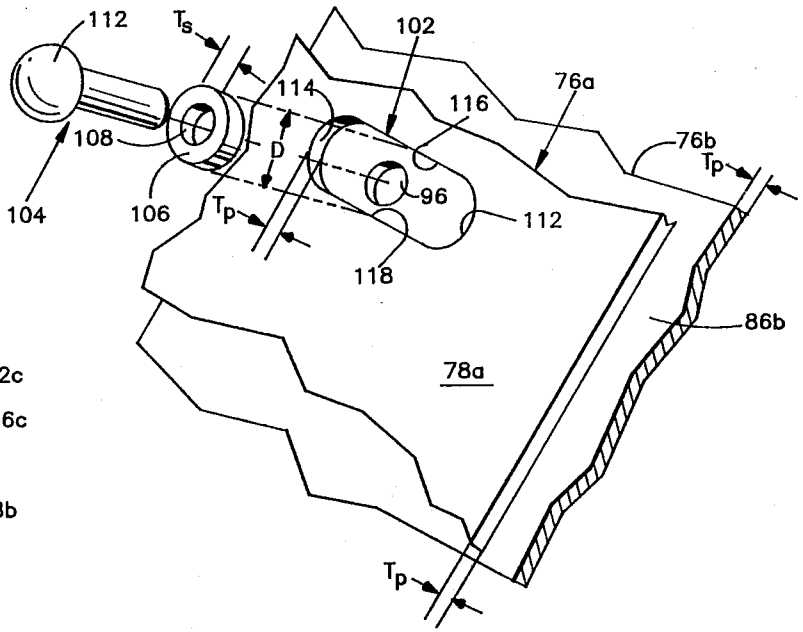
FIG. 5 is an enlarged perspective view of adjacent arcuate segments showing a slot and fastener construction for allowing a limited amount of circumferential movement between segments.

FIG. 5 is an enlarged view of a portion of the perspective view shown in FIG. 4 showing in more detail the relationship of the spacer 106 to the outer plate **86*b* and to the slot 102 in first end 78*a* of the nested segment 76*a*. The slot has a first end 112, a second end 114 spaced circumferentially from the first end, and, an upstream side 116 and a downstream side 118** spaced axially from the upstream side which extend, circumferentially between the ends.

Figure 7:
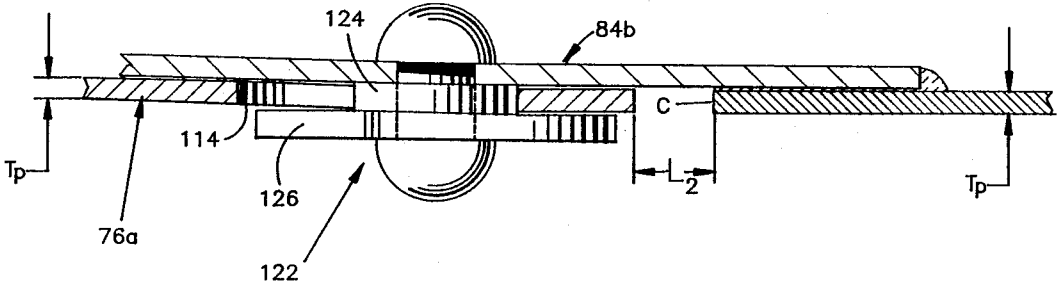
FIG. 7 is an alternate embodiment of the construction shown in FIG. 6 which has a single plate extending from one segment to overlap the adjacent segment.

The spacer 106 has a thickness Ts to insure that the plates are spaced apart by the predetermined distance Ts. The thickness Ts of the spacer is slightly greater than the thickness Tp of the plates. The spacer has a diameter D which is equal to the distance between the sides of the slot. In an alternate embodiment, the inner plate might be eliminated and the rivet might have an enlarged head 112 which extends over the sides of the slot to radially urge the nested segment against the plate, such as is shown in FIG. 7. Alternatively, the fastener might have a spacer with a collar on the spacer which overlaps the sides of the slot.

Figure 6:
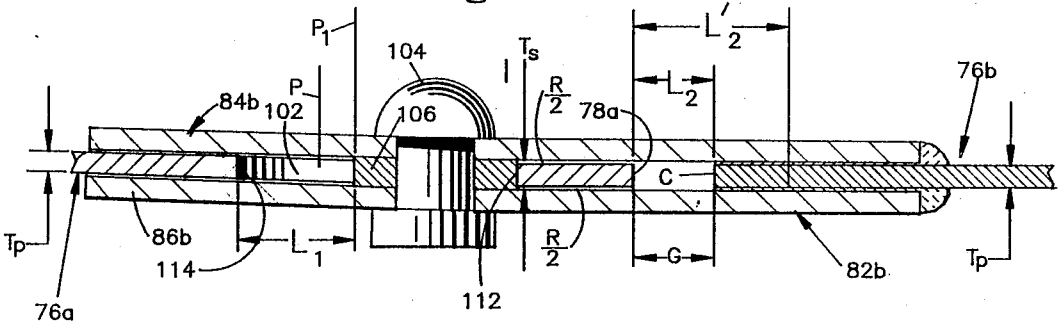
FIG. 6 is an enlarged cross-sectional view of a portion of the inner case shown in FIG. 3.

FIG. 6 is a cross-sectional view taken along the lines 6—6 of FIG. 2 which is enlarged to show the relationship of the first segment **76*a* to the second segment 76*b*. More particularly, FIG. 6 shows the relationship of the the inner plate 84*b* and the outer plate 86*b* of the second segment to the fastener formed of the spacer 106 and the rivet 104. The difference in radial thickness Ts of the spacer 106 and the radial thickness of the plate Tp provides a predetermined radical clearance gap R between the adjacent segments. Ideally, each side of the segment 76*a*** will be spaced by a distance R/2 from the adjacent plate.

As shown in FIG. 6, the location of the parts corresponds to an engine operative condition at which the radially aligned portions of the two segments are at their maximum circumferential separation leaving the circumferential gap G therebetween. At this position of the segments, the spacer 106 is separated by the distance $L_1$ from the second end 114 of the slot 102 in the nested segment 76*a*. The first end of the nested segment is spaced by the circumferential distance $L_2$ (clearance gap G) from the radially aligned portion of the second end 82*b* adjacent segment. Because $L_2$ is smaller than $L_1$, at zero clearance G, as the outer case contracts forcing the inner case to its minimum diameter, the end 78*a* of the first segment will abuttingly contact the second segment at C. The second end 114 of the slot will not exert shearing forces on the rivet 104 through the spacer 106. This is preferred to constructions where the maximum gap $L_2$ is greater than the distance $L_1$, and the second end 114 of the slot is movable to the position $P_1$ where exerts shearing forces on the rivet.

FIG. 7 is a cross-sectional view of an alternate embodiment of the embodiment shown in FIG. 6 which has a spacer 122 having a shoulder or inner section 124 in place of the construction using a rivet 104 and a second plate 84*b* or 86*b* shown in FIG. 6. The inner section 124 of the spacer has a controlled radial dimension. The outer section 126 is disc shaped having a diameter which allows the spacer to overlap the nested plate 76*a* in either the axial direction, the circumferential direction or in both the axial and circumferential directions. In this particular embodiment, the distance $L_1$ is equal to the distance $L_2$ such that the end of the nested segment abuts the radially aligned portion of the adjacent segment at C and the spacer abuts the second end 114 of the slot.

Figure 8:
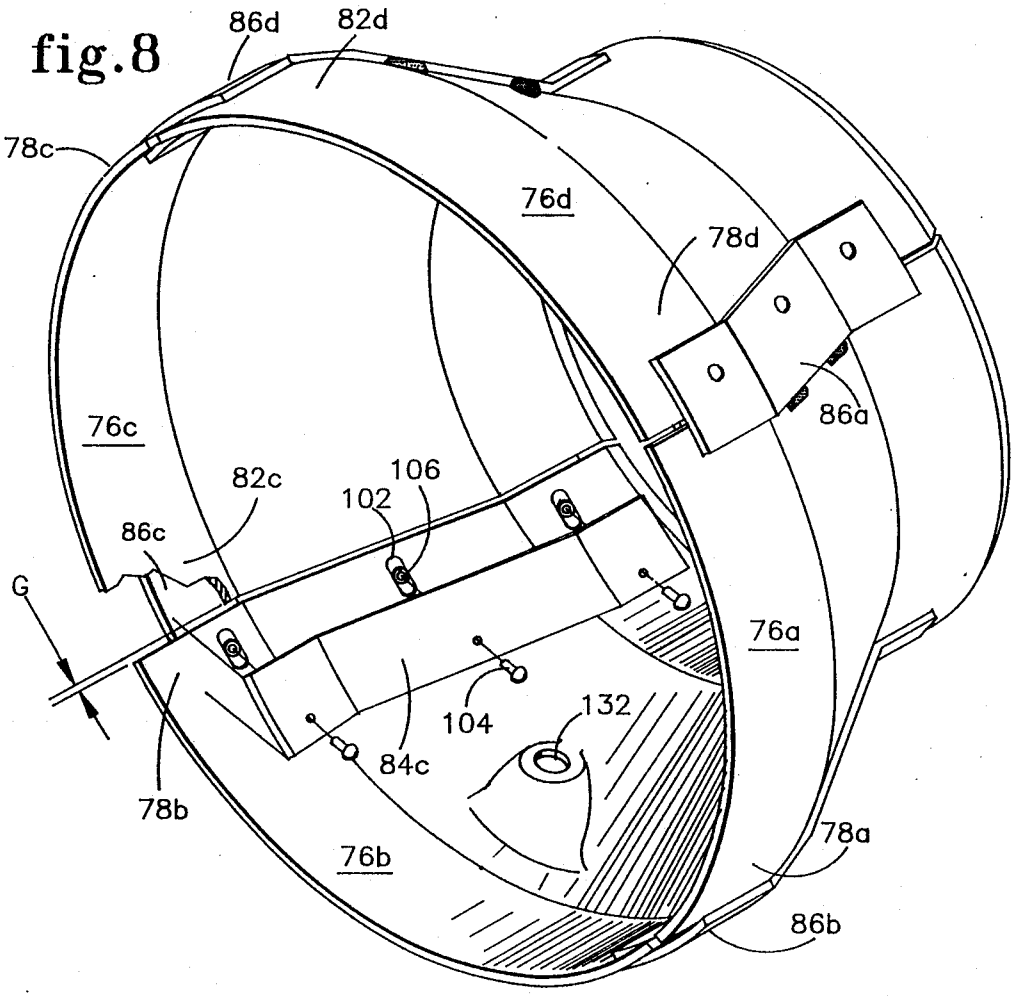
FIG. 8 is a perspective view of the freestanding inner case with an inner plate shown in exploded relationship to the adjacent segments.

FIG. 8 is a perspective view of the four circumferentially extending segments shown in FIG. 3. A local opening 132 in the side of one of the segments permits access to the interior of the engine for a borescope which extends through a local outer hole in the outer casing, the inner casing 56 and between the adjacent duct segments 34. The inner plate 84*c* is shown in an exploded position to show the relationship of the plate to the slots 102 and spacers 106 and rivet 104 at three locations. In the assembled condition, the inner casing is a freestanding structure and may be handled as a unit with the plates and the slot-spacer-rivet construction providing for a limited amount of circumferential movement without destroying the orientation of the segments to each other during the assembly process.

During assembly, the spacer 106 is disposed in each slot of the first (nested) segment 76*b* and the nested segment is slid circumferentially into the second segment 76*c*. The spacer is aligned with the holes 96,98 in the plates 84*c*,86*c* and a rivet 104 is inserted through the inner plate, through the spacer and through the outer plate. The rivet, the adjacent sheet metal segments and the spacer may be formed of any suitable material, such as Aerospace Material Specification (AMS) 7232 nickel alloy for the rivets, AMS 5598 nickel alloy for the segments, and AMS 5536 nickel alloy for the spacer. The thickness of the plate and the arcuate segments is approximately thirty thousandths of an inch (0.030") and the spacer is approximately three thousandths of an inch (0.003") thicker than the segments to insure free movement during assembly and under operative conditions of the engine.

The rivet is deformed at its inner end such that the rivet overlaps the outer plate urging the plates against the spacer with the spacer controlling the radial gap R between the plates. The remaining segments are assembled to the adjacent segments and rivets are inserted in a similar fashion until the inner casing is assembled as a freestanding structure. The structure is moved in its entirety to the engine and slid within the outer case 22 with stops on each segment (as shown by the stop 134) engaging the downstream flange 52 to axially position the inner case or baffle within the outer case. The duct segments 34 slide axially into position with the upstream flange 42 of the duct segment engaging the upstream flange 54 on the inner case and the vanes 32 are assembled to the downstream flange on the inner case overlapping the downstream flange on the duct and engaging the outer flange 52 to trap the duct segments and the inner case thereby attaching the inner case to the outer case.

During operation of the gas turbine engine shown in FIG. 1, working medium gases are flowed along the annular flowpath 18 which extends axially through the engine. The gases are compressed in the compression section 12 and mixed with fuel in the combustion section 14. The gases and fuel are burned together to add energy to the gases. The hot, high pressure gases are flowed from the combustion section to the turbine section 16 of the engine. The gases are expanded in the turbine section through rows of rotor blades, such as the rotor blades 30, and stator vanes, such as the stator vanes 32, to extract useful work from the gases.

As the gases are discharged from the array of rotor blades 30 at the downstream end of the high pressure turbine 26, the gases are passed through the transition region 36. The gases experience a sudden expansion in the transition region before being passed into the low pressure turbine 28. Because of the sudden expansion of the working medium gases, the velocity of the hot gases decreases and the static pressure increases. Heat is transferred from the gases to the adjacent wall segments of the engine and to the stator vanes downstream of the wall. Cooling air is flowed along the cooling air flowpath which extends through the first flange into the chamber and thence through the downstream flange into the downstream chamber. The cooling air is confined to its flowpath by the circumferentially extending inner casing 56 or baffle.

As heat is transferred from the working medium gases to the baffle and the outer case, the inner case reacts thermally more quickly than the outer case by reason of its closer proximity to the hot, working medium gases and its thermal capacitance of the which is smaller than the capacitance outer case. As a result, the length of each segment expands with respect to the outer case and the circumferential gap G between the radially and aligned portions of the adjacent segments 76*a*,76*b* decreases. As the outer case continues to receive heat from the working medium gases, the outer case begins to increase in temperature, resulting in thermal expansion of the outer case and the outer case moving to a larger diameter. As the outer case moves to a larger diameter, the trapped inner case is moved outwardly with the increased diameter outer case to a larger diameter. The circumferential gap G between adjacent segments increases, with the increase in circumferential gap being unevenly distributed between adjacent segments by reason of unevenness in the change of the diameter of the outer case and different amounts of frictional force exerted by the trapping structure on the inner case. The different frictional forces result from tolerance variations and other structural variations and because of differences in the normal force exerted by the trapping structure on the inner case. Thus, relative movement between adjacent segments may be greater for some pairs of adjacent segments than for other pairs of adjacent segments.

As the segments of the inner case continue to be pulled apart and increasing the clearance gap G grow the fastener engages the first end 112 of the slot 102 in abutting contact limiting the circumferential gap to the distance $L_2$. The first end 78*a* of the first segment pulls the second segment in the circumferential direction and causes the nested end of the second segment to move circumferentially toward the maximum circumferential gap G between the second segment and the adjacent third segment. Finally, the nested end of the second segment engages the fastener on the third segment causing the circumferential gap between the third segment and the fourth segment to increase. As a result, each of the segments shares the expansion in circumferential gap, uniformly distributing the total circumferential growth of the structure over all of the joints. This avoids allowing all the circumferential movement to occur between a single pair of adjacent segments with a concomitant opening of a leak path between the adjacent segments and results in an increase in engine efficiency in comparison with those constructions in which cooling air or working medium gases are lost from one engine chamber to another.

As cooling air is impinged on the outer case, the outer case shrinks in diameter urging the arcuate segments to a smaller diameter. The radial spacer presets the radial gap between the nested segment and the plates 84,86 to decrease frictional force between the segments and facilitate relative movement between segments. The preset radial gap minimizes leakage along a flowpath which extends from the chamber 58 between the nested segment and the inner plate to the gap G and between the nested segment and the outer plate to the working medium flowpath under operative conditions of the engine at which the chamber pressure exceeds the pressure of the flowpath. The flowpath passes along a tortuous route encountering both a sudden expansion and a sudden contraction which further increases the resistance to the leakage of cooling air, which further improves engine efficiency.

The construction shown in FIG. 7 works in a manner similar to the construction shown in FIG. 6. However, the single circumferentially extending plate 84*b* only provides a single overlapping seal between the adjacent segments. Nevertheless, the spacer and rivet maintain the overlapping relationship in both the radial and circumferential directions.

Other means might be used to attach plates together such as nut and bolt combination rather than a rivet, or a blind rivet might be used which extends only through one of the plates into the slot. In addition, the stepped washer might be replaced with a rivet having a broad plate. The broad plate is similar to the disk 124 but is integral with the rivet rather than the spacer.

Although the invention has been shown and described with respect to detailed embodiments thereof, it should be understood by those skilled in the art that various changes in form and detail thereof may be made without departing from the spirit and the scope of the claimed invention. We claim:

We claim:

1. A stator assembly for a rotary machine having a flowpath for working medium gases machine, which comprises:

a first case which extends circumferentially with respect to the working medium flow path;

a second case spaced radially from the first case which is radially positioned by the first case and which has at least two circumferentially extending segments which overlap in the circumferential direction and which are relatively slidable in the the circumferential direction, each segment having an end which is radially aligned with the end of the adjacent segment and circumferentially spaced therefrom leaving a circumferential gap therebetween;

wherein the first segment has a circumferentially extending slot in the end of the segment and the second segment has a fastener which extends radially through the slot to permit slidable circumferential movement between the segments and extends in a non-radial direction to position the first segment radially from the second segment and radially with respect to the second segment.

2. The stator assembly as claimed in claim 1 wherein a spacer is disposed in the slot of the first segment and is disposed between the plate of the second segment and the non-radial portion of the fastener to establish a clearance in the radial direction for the slidable first segment.

3. The stator assembly as claimed in claim 2 wherein the spacer is part of the fastener.

4. The stator assembly as claimed in claim 3 wherein the slot has a circumferentially extending upstream side and a downstream side, the spacer slidably engaging the sides of the slot to axially align the adjacent segments.

5. The stator assembly as claimed in claim 1 wherein the slot in the first segment is closed, the first segment having an axially extending end which is disposed between the clearance gap G and the fastener to limit the maximum size of the circumferential gap G by abuttable engagement between the end of the first segment and the fastener as the segments move apart in response to operatives condition of the engine.

6. The stator assembly as claimed in claim 1 wherein the second segment has an inner plate and an outer plate spaced radially from the inner plate leaving a radial gap therebetween, each plate overlapping the slot in the first segment, and wherein the first segment is nested within the radial gap and the fastener extends between the plates to set the radial gap therebetween.

7. The stator assembly as claimed in claim 6 wherein the slot has a circumferentially extending upstream side and a downstream side, the spacer slidably engaging the sides of the slot to axially align the adjacent segments.

8. The stator assembly as claimed in claim 7 wherein the slot in the first segment is closed, the first segment having an axially extending end which is disposed between the clearance gap G and the fastener to limit the maximum size of the circumferential gap G by abuttable engagement between the end of the first segment and the fastener as the segments move apart in response to operative conditions of the engine.

9. The stator assembly as claimed in claim 8 wherein the first case is an outer case and the second case is an inner case.

10. A stator assembly for a gas turbine engine which extends circumferentially about a working medium flowpath, and which comprises:

an outer case extending circumferentially about the working medium flow path;

a wall bounding the working medium flow path which has a plurality of arcuate wall elements, each wall element extending circumferentially and having an upstream flange and a downstream flange which are radially attached to and circumferentially slidable with respect to the outer case such that the outer case radially positions the wall;

an inner case which extends circumferentially about the engine, and which is trapped between the outer case and the wall bounding the working medium flowpath, the inner case including a plurality of arcuate segments which extend circumferentially and are circumferentially spaced one from the other leaving a circumferential clearance gap G therebetween, each segment being circumferentially movable with respect to the adjacent segment, at least one pair of circumferentially adjacent segments including a first segment having a first end, a second end and a closed slot which extends circumferentially in the segment, the segment having a surface which bounds the slot, the slot including a first end adjacent the first end of the segment, a second end spaced circumferentially away from the first end, of the slot and the first end of the segment and a downstream side and an upstream side spaced axially from the downstream side, the sides extending circumferentially between the ends, an adjacent second segment having a pair of circumferentially extending plates which are spaced radially leaving a radial gap therebetween, the segment having a fastener which extends radially between the plates;

wherein the first end of the second segment extends between the plates such that the plates overlap the slot and the fastener extends radially through the slot in the first segment to form a fastener and slot assembly, wherein the inner case is positioned radially by the outer case and accommodates changes in diameter by slidable movement between the adjacent segments in the circumferential direction which is permitted by circumferential movement of the fastener in the slot, and wherein the fastener abuttingly engages the first end of the slot to limit the maximum amount of circumferential clearance between adjacent segments to a predetermined amount and to prevent the plates from moving to a position at which the plates do not overlap the adjacent segment.

11. The stator assembly as claimed in claim 10 wherein the inner case has at least three arcuate segments and the adjacent ends of each pair of adjacent segments has a slot and fastener assembly to cause the circumferential gaps between each pair of segments to reach a predetermined value at operative conditions of the engine which cause the first end of the slot of each segment to abuttingly engage the associated fastener.

12. The stator assembly of claim 11 wherein each gap has the same predetermined maximum value to more evenly distribute rdial movement of the segments and relative circumferential movement between the segments.

13. The stator assembly of claim 11 wherein the plates are an inner plate and an outer plate, wherein the fastener extends through the plates and has a first end which engages the inner plate and urges the first plate radially outwardly and the fastener has a second end which engages the outer plate and urges the outer plate inwardly.

14. The stator assembly of claim 11 wherein the fastener includes a spacer which is disposed between the radial plates to urge the plates apart and the plates are urged radially against the spacer by the fastener to provide a predetermined gap Ts which is greater than the thickness Tp of the first segment.

15. The stator assembly of claim 11 wherein the fastener is attached to at least one of the plate and extends between the plates.

16. The stator assembly of claim 15 wherein the pin assembly includes a spacer which extends axially between the sides of the slot and radially between the plates to slidably engage the sides of the first segment and to abuttingly engage the plates to positively space the plates apart to permit relative circumferential movement between the segments while limiting relative axial movement between the segments.

17. A method of assembling an inner case and an outer case for a rotary machine having a working medium flowpath, comprising the steps of:

forming a circumferentially continuous outer case which is adapted to extend about the working medium flowpath;

forming a freestanding inner casing formed of at least two circumferentially extending segments, each of the segments overlapping the adjacent segment in the circumferential direction and being capable of slidably engaging the segments in the circumferential direction, the adjacent segments at each circumferentially facing end having a circumferentially extending slot in one of the segments, the slot having two ends and the other segment having a fastener which extends radially into the slot and between the ends of the slot to limit the maximum relative circumferential movement between the segments;

installing the freestanding inner casing as a unit which is linked together by the fastener and the slot to positively align the segments in the circumferential and axial direction; and, attaching the inner case to the outer case such that the inner case is spaced radially over at least a portion of the inner case from the outer case and is positioned by the outer case.

* * * * *

UNITED STATES PATENT AND TRADEMARK OFFICE

CERTIFICATE OF CORRECTION

PATENT NO. : 4,921,401

DATED : May 1, 1990

INVENTOR(S) : Theodore W. Hall et. al.

It is certified that error appears in the above-identified patent and that said Letters Patent is hereby corrected as shown below:

In the Title, "CASTING FOR A ROTARY MACHINE" should read --CASING FOR A ROTARY MACHINE--.

Col. 1, line 1, "CASTING FOR A ROTARY MACHINE" should read --CASING FOR A ROTARY MACHINE--.

Signed and Sealed this

Twenty-seventh Day of August, 1991

*Attest:*

HARRY F. MANBECK, JR.

*Attesting Officer*

*Commissioner of Patents and Trademarks*